US007170469B2

(12) United States Patent
Gong et al.

(10) Patent No.: US 7,170,469 B2
(45) Date of Patent: Jan. 30, 2007

(54) METHOD AND APPARATUS FOR IMAGE FRAME SYNCHRONIZATION

(75) Inventors: Jin-Sheng Gong, Tao-Yuan Hsien (TW); Issac Chen, Kao-Hsiung (TW)

(73) Assignee: Realtek Semiconductor Corp., HsinChu (TW)

( * ) Notice: Subject to any disclaimer, the term of this patent is extended or adjusted under 35 U.S.C. 154(b) by 324 days.

(21) Appl. No.: 10/604,407

(22) Filed: Jul. 18, 2003

(65) Prior Publication Data

US 2005/0012738 A1 Jan. 20, 2005

(51) Int. Cl.
*G09G 5/00* (2006.01)

(52) U.S. Cl. ..... 345/3.2; 345/213; 345/698

(58) Field of Classification Search ..... 345/3.1–3.4, 345/211–213, 698, 699
See application file for complete search history.

(56) References Cited

U.S. PATENT DOCUMENTS 5,448,257 A * 9/1995 Margeson et al. ..... 345/3.2
5,739,867 A 4/1998 Eglit
6,002,446 A 12/1999 Eglit
6,177,922 B1 * 1/2001 Schiefer et al. ..... 345/698
6,181,300 B1 * 1/2001 Poon et al. ..... 345/698
6,285,402 B1 9/2001 Miyazaki et al.
6,313,822 B1 * 11/2001 McKay et al. ..... 345/698
6,545,688 B1 * 4/2003 Loveridge et al. ..... 345/660
6,686,894 B2 * 2/2004 Okuno et al. ..... 345/3.2
2003/0184678 A1 10/2003 Chen et al.
2005/0012738 A1 * 1/2005 Gong et al. ..... 345/212

FOREIGN PATENT DOCUMENTS

WO WO 03/071513 A2 8/2003

* cited by examiner

*Primary Examiner*—Regina Liang
(74) *Attorney, Agent, or Firm*—Winston Hsu

(57) ABSTRACT

A method and apparatus for converting a source frame signal received at a first frame rate to a destination frame signal output at a second frame rate. By adjusting the number of pixel data in the destination frame signal, the second frame rate is made to be the same as the first frame rate. Adjusting the amount of non-visible porch signals for at least one horizontal line of the destination frame signal prevents overflow and underflow conditions. The number of non-visible porch signals is increased to prevent underflow or decreased to prevent overflow. The number of non-visible porch signals in the last horizontal line is adjusted to comply with some display devices having a maximum time constraint from a last horizontal sync signal to a vertical sync signal in the destination frame signal.

26 Claims, 5 Drawing Sheets

METHOD AND APPARATUS FOR IMAGE FRAME SYNCHRONIZATION

BACKGROUND OF INVENTION

1. Field of the Invention

The invention relates to video display devices, and more particularly, to converting from a first display resolution to a second display resolution using image frame synchronization.

2. Description of the Prior Art

Graphics systems display images on display screens. For example, a computer system may display an image on a flat-panel monitor. Television systems and cameras are additional examples of such graphics systems. To achieve the display of an image, the image is generally represented by image data (e.g., RGB data), and display signals are generated from the image data. The standard VGA format is 640 pixels wide by 480 pixels high. The display signals for a standard VGA monitor must redraw the entire screen at least 60 times a second to avoid causing a flicker that can be seen by the human eye and to allow smooth motion of the image. This period is called the refresh rate and the screen refresh process typically begins in the top left corner and displays 1 pixel at a time from left to right. When the current row is finished the next row is displayed in the same manner until all rows have been displayed and the refresh process begins again.

FIG. 1 shows a timing diagram 10 of the typical display signals for a VGA system. The display signals including a vertical sync signal VS indicating the beginning of each screen, also called a frame; a horizontal sync signal HS indicating the beginning of each row, also called a horizontal line; and a data enable line indicating the pixel data in each scan line. As shown in FIG. 1, a first frame starts at the first rising edge E1 of the vertical sync signal and a second frame starts at the second rising edge E2.

As graphics systems continue to have higher and higher display resolutions, a need emerges to convert image data from a first resolution to a second resolution. Graphics systems typically use special circuitry to convert image resolution. Examples of such circuitry include the well-known graphics controller chips typically housed on a motherboard of a computer system and LCD control chip sets provided with LCD panels and video cameras. Frame rate conversion is a common technique well known in the art and involves outputting a destination display signal at a different frame rate than the incoming display signal. Because the incoming and outgoing frame rates are different, a large memory is needed to store incoming and outgoing pixel data, increasing the cost and complexity of the graphics system.

With the advance of graphics systems technology, a larger degree of tolerance for the outgoing frame rate is acceptable. For most new displays, it is sufficient to use the same frame rate for the source display signals and the destination display signals, simplifying the design and reducing the required memory. This technique is called frame synchronization and involves generating a destination frame for each source frame received and outputting the destination frames at the same rate as the source frames are received.

A significant timing problem is inherent in frame synchronization. The source signals contain both visible horizontal lines and non-visible horizontal lines. Resolution is normally specified in terms of visible pixels only but, in reality, there are the additional non-visible horizontal lines and non-visible pixels at the ends of the visible horizontal lines. If a resolution is converted from x to y then the ratio of x:y must also hold for the non visible horizontal lines. An example of where difficulties are encountered is when converting frame signals for a typical VGA system. As previously mentioned, the typical VGA system is 640×480, or 480 horizontal lines; however, in reality there are approximately 504 horizontal sync signals sent for each vertical sync signal. The extra horizontal lines are not visible but are present to allow the display device time to return to the upper left corner before beginning the next refresh cycle. The ratio of visible source horizontal lines to visible destination horizontal lines must be equal to the ratio of total source horizontal lines to total destination horizontal lines. If a destination display device having a resolution of 1280×1024 is to be used, this equates to 1024/480*504 or a total of 1075.2 destination horizontal lines. The value of the destination horizontal lines must be an integer but if this value is rounded up, overflow occurs because the source frame rate will be higher than the destination frame rate. Conversely, if this value is rounded down, underflow occurs because the source frame rate will be lower than the destination frame rate.

SUMMARY OF INVENTION

It is therefore a primary objective of the claimed invention to provide a method and apparatus for image frame synchronization, to solve the above-mentioned timing problem to prevent overflow and underflow.

According to the claimed invention, a method of frame synchronization for converting a source frame signal to a destination frame signal is disclosed. The source frame signal is received at a first frame rate and the destination frame signal is output at a second frame rate. The destination frame signal includes a plurality of horizontal lines and each of the horizontal lines includes a plurality of pixel data. The method comprises outputting the destination frame signal according to the source frame signal; and adjusting the number of the pixel data of at least one of the horizontal lines such that the first frame rate and the second frame rate are substantially the same.

According to the claimed invention, an apparatus for converting a source frame signal to a destination frame signal is disclosed. The source frame signal is received at a first frame rate and the destination frame signal is output at a second frame rate. The destination frame signal includes a plurality of horizontal lines and each of the horizontal lines includes a plurality of pixel data. The apparatus comprises a buffer for storing at least a part of the pixel data and a converter for adjusting the number of the pixel data of at least one of the horizontal lines such that the first frame rate and the second frame rate are substantially the same.

It is an advantage of the claimed invention that by adjusting the number of pixel data in the last horizontal line, a last horizontal sync signal and a vertical sync signal can be made to be within in a predetermined time period.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
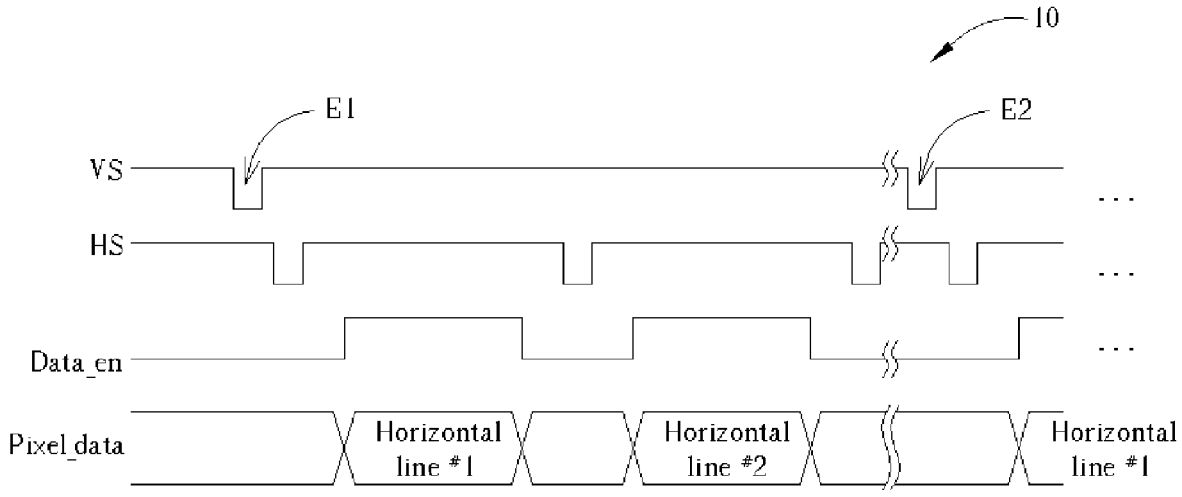
Fig. 1 Prior art
FIG. 1 is a timing diagram of typical video signals according to the prior art.
Figure 2:
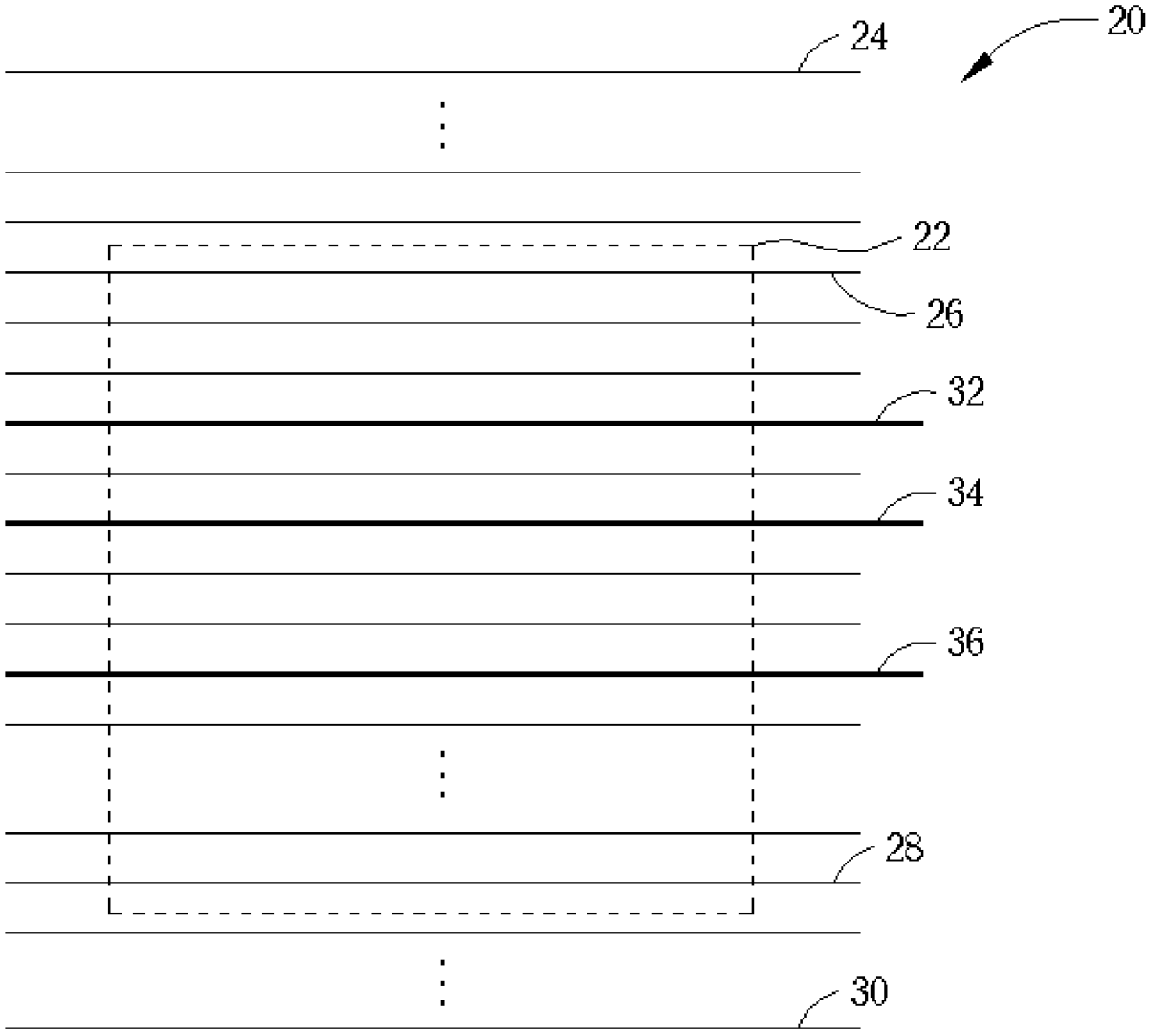
FIG. 2 is an image frame according to the present invention.

FIG. 2 shows a destination frame 20 according to the present invention. The destination frame 20 includes a first horizontal line 24, a first visible horizontal line 26, a last visible horizontal line 28, and a last horizontal line 30. The horizontal lines contain pixel data comprising both non-visible porch signals and visible pixel signals. For this reason, FIG. 2 also includes a visible region 22 indicating the pixel signals that are visible and displayed on the display device. The visible region 22 encloses the pixel signals and all pixel data outside the visible region are the non-visible porch signals. As an example, the visible region 22 can be thought of as the video screen of a computer monitor or an LCD panel. Throughout the remainder of the disclosure, the term pixel data refers to the both the non-visible porch signals and the visible pixel signals.

By adjusting the number of non-visible porch signals for the image frame 20, the underflow and overflow problems of the prior art are solved. When an underflow condition exists, the source frame rate is slightly lower than the destination frame rate. Additional non-visible porch signals are added to the horizontal line of the destination image frame to increase the total number of the pixel data of the destination image frame and slow down the destination frame rate. The number of additional porch signals added ensures that the source frame rate is the same as the destination frame rate. The additional porch signals are distributed among the horizontal lines of the image frame. In FIG. 2, extra porch signals have been added to horizontal lines 32, 34, and 36. Similarly, to correct an overflow condition, some non-visible porch signals could be removed from some of the horizontal lines in the destination image frame, thereby decreasing the total number of the pixel data of the destination image frame and increasing the destination frame rate.

Because extra porch signals are added (or removed) at the end of the horizontal line in the non-visible section, by the time the display device reaches the end of the horizontal line, it has already drawn the horizontal line and automatically accounts for a slight delay (advance) in receiving the next horizontal sync signal. The need for the non-visible porch signals originally came from CRT display devices needing time to move to the starting position of the next horizontal line. For many digital display devices the porch signals are not a critical element of the display and the number can be slightly adjusted on a horizontal line by horizontal line basis. However, due to the internal design of some display devices, for example some LCD panels, there may be a constraint that the number of pixel data in each horizontal line needs to be an even number. This is due to the way the clocking system works in the LCD panel as some panels use a divide by two clock and work with pixels in groups of two. There also exist a number of panels that use a divide by four clock and for these particular panels the number of pixel data in each horizontal line needs to be divisible by four.

Figure 3:
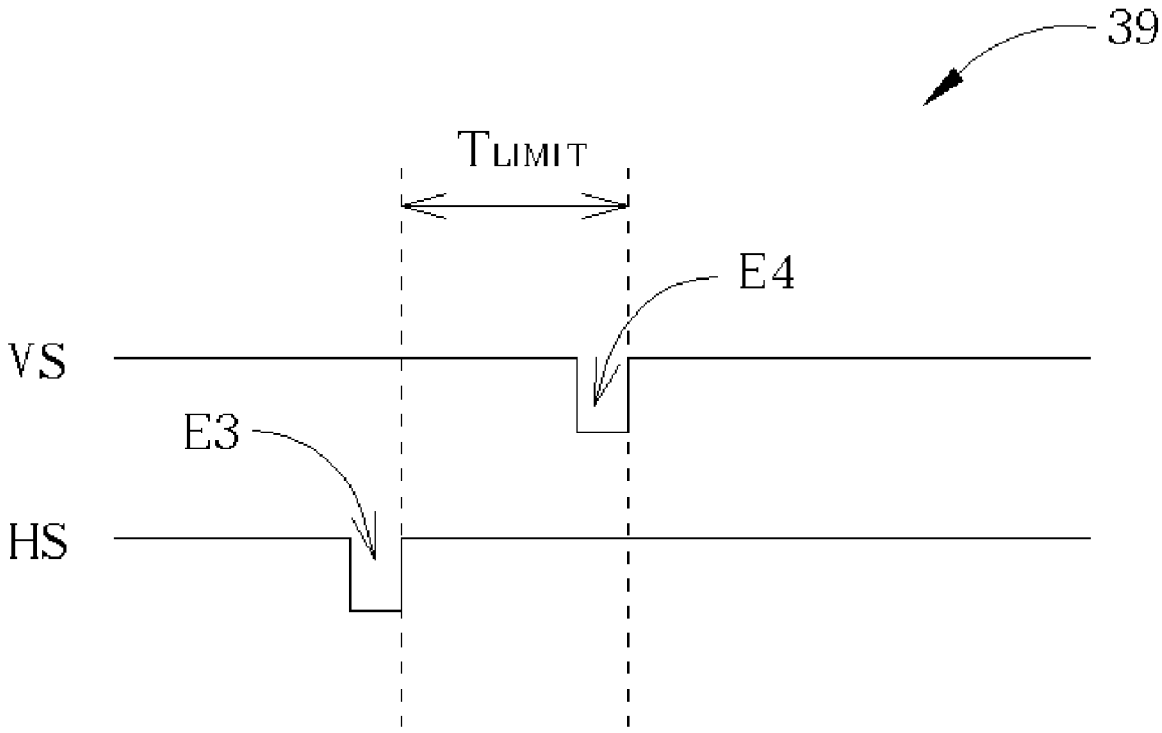
FIG. 3 is a timing diagram showing the timing constraint of the horizontal sync signal to the vertical sync signal.

FIG. 3 shows a timing diagram 39 of the relationship between the vertical sync signal VS and the horizontal sync signal HS. For some destination display devices, particularly some LCD panels, there is an additional hardware restriction limiting the maximum time $T_{LIMIT}$ between the last horizontal sync signal and the vertical sync signal. The start of the last horizontal sync signal HS, represented by a third rising edge E3, must be within a time $T_{LIMIT}$ of the start of the vertical sync signal VS, represented by a fourth rising edge E4. For some display devices, the video signals need to comply with this restriction or the display device will not function properly.

To satisfy this timing requirement, the number of porch signals in the last horizontal line of the destination frame is reduced and in order to maintain the destination frame rate, at least one of the other horizontal lines in the destination frame has its number of porch signals increased. When correcting the timing between the horizontal sync signal and the vertical sync signal, the total number of pixel data in the destination frame remains constant so as to not affect the destination frame rate.

Figure 4:
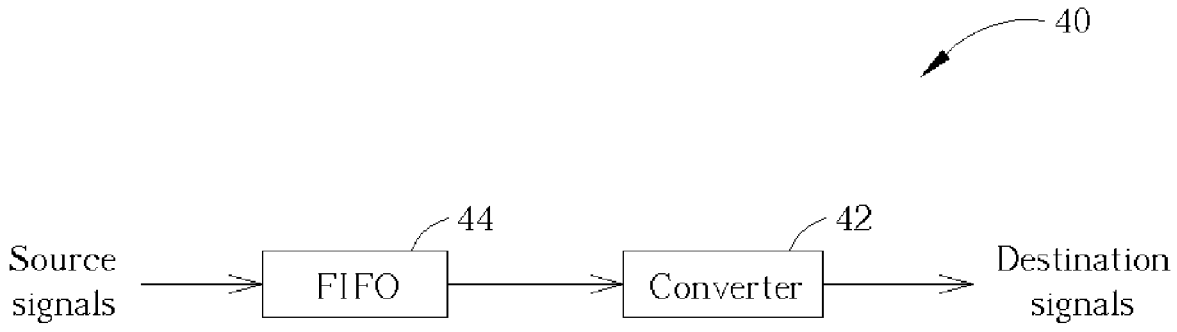
FIG. 4 is a frame synchronization apparatus according to the present invention.

FIG. 4 shows a frame synchronization apparatus 40 according to the present invention. The frame synchronization apparatus 40 includes a converter 42 and a First-In-First-Out (FIFO) buffer 44. Source video signals at a first display resolution are received at a first frame rate and stored in the FIFO 44. The FIFO 44 stores the incoming pixel data until it is read out of the FIFO 44 by the converter 42, of which the structure and the operation are well-known by people skilled in the art, to convert from the first resolution to the second resolution. For each image frame in the source video signals, the converter 42 generates a destination frame in the destination video signals at a second frame rate. It should also be noted that although the FIFO 44 is used as a buffer, this is for example only and any buffer implementation can be used.

If the first frame rate is higher than the second frame rate, pixel data will overflow the FIFO 44. To increase the second frame rate, the converter 42 decreases the number of non-visible porch signals in at least one of the horizontal lines of the destination frame such that the FIFO 44 is no longer in the overflow condition. When some porch signals are removed from the destination frame, the frame takes less time to transmit and the second frame rate is increased. If the first frame rate is lower than the second frame rate, pixel data will be read out of the FIFO 44 too quickly and the FIFO 44 will underflow. To decrease the second frame rate, the converter 42 increases the number of porch signals in at least one of the horizontal lines in the destination frame such that the FIFO 44 is no longer in the underflow condition. The converter 42 adjusts the number of non-visible porch signals in the destination frame such that the pixel data in the FIFO 44 remains above a minimum level and below a maximum level. In this stable condition, the first frame rate and the second frame rate are substantially the same.

To ensure compatibility with some destination display devices, the converter 42 may be required to make the number of pixel data in each horizontal line divisible by two or four depending on if the destination display device uses a divide by two or a divide by four clock respectively. Additionally, the number of porch signals in the last horizontal line of the destination frame may need to be reduced to allow the time between the last horizontal sync signal and the vertical sync signal to be within a maximum allowable time limit. These adjustments are dependent on the particular destination display and, regardless of whether required or not, the converter 42 ensures that the FIFO 44 is not in an overflow or underflow condition.

Figure 5:
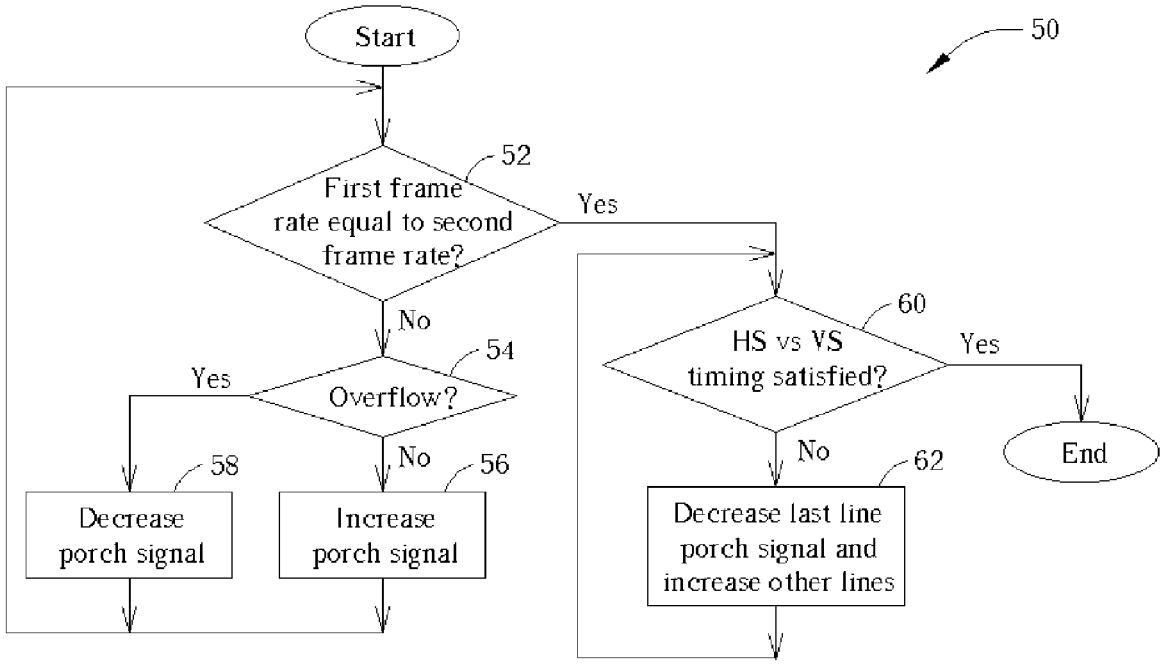
FIG. 5 is a flowchart showing the method of image frame synchronization according to the present invention.

FIG. 5 shows a flowchart 50 illustrating the method of frame synchronization according to the present invention. The flowchart 50 comprises the following steps:

Step 52: Determine if the first frame rate is equal to the second frame rate. A simple method for determining whether the first frame rate is equal to the second frame rate is checking whether incoming pixel data in a buffer or memory remains above a minimum level and below a maximum level. In this stable condition, the first frame rate and the second frame rate are substantially the same so proceed to step 60, otherwise proceed to step 54.

Step 54: Check for an overflow condition. If an overflow condition exists then proceed to step 58, if not (underflow) then proceed to step 56.

Step 56: Increasing the number of porch signals increases the size of the destination frame and lowers the second frame rate. For some destination displays, it may also be necessary to ensure that the number of pixel data in each horizontal line is a multiple of two or a multiple of four. Proceed to step 52.

Step 58: Decreasing the number of porch signals decreases the size of the destination frame and increases the second frame rate. For some destination displays it may also be necessary to ensure that the number of pixel data in each horizontal line is a multiple of two or a multiple of four. Proceed to step 52.

Step 60: Determine if the timing requirements for the horizontal sync signal and the vertical sync signal of the destination display are satisfied. If satisfied then end, if timing adjustment is needed then proceed to step 62.

Step 62: Decrease the number of porch signals in the last horizontal line. Because the second frame rate must remain constant, the total number of porch signals that are added to other horizontal lines must be equal to the number of porch signals removed from the last horizontal line. Proceed to step 60.

Those skilled in the art will readily observe that numerous modifications and alterations of the device may be made while retaining the teachings of the invention. Accordingly, that above disclosure should be construed as limited only by the metes and bounds of the appended claims.

What is claimed is:

1. A method of frame synchronization for converting a source frame to a destination frame, the source frame being received at a first frame rate and the destination frame being outputted at a second frame rate, the method comprising the following steps:

buffering at least a part of the source frame;

determining whether a predetermined condition is satisfied;

if the predetermined condition is satisfied, converting the source frame to the destination frame with a first amount of pixel data; and if the predetermined condition is dissatisfied, converting the source frame to the destination frame with a second amount of pixel data;

wherein the first amount is different from the second amount;

wherein the first amount of pixel data comprises a third amount of invisible porch signals, the second amount of pixel data comprises a fourth amount of invisible porch signals, and the third amount is different from the fourth amount.

2. The method of claim 1, wherein the step of converting the source frame to the destination frame with the first amount of pixel data further comprises adjusting a time for generating a vertical sync signal such that the first frame rate is different from the second frame rate, and the step of converting the source frame to the destination frame with the second amount of pixel data further comprises keeping the time for generating the vertical sync signal unchanged such that the first frame rate is substantially the same as the second frame rate.

3. The method of claim 1, wherein the predetermined condition is a time interval between a last horizontal sync signal and a vertical sync signal shorter than a time limit, and the first amount is more than the second amount if the predetermined condition is satisfied.

4. The method of claim 1, wherein the predetermined condition is a number of pixel data for constructing the destination frame being an odd number, and the first amount is more than the second amount if the predetermined condition is satisfied.

5. The method of claim 1, wherein the predetermined condition is an overflow condition, and the first amount is fewer than the second amount.

6. The method of claim 5, wherein the step of determining whether the predetermined condition is satisfied comprises:

determining whether the amount of the source frame being buffered is over a maximum level.

7. The method of claim 1, wherein the predetermined condition is an underflow condition, and the first amount is more than the second amount.

8. The method of claim 7, wherein the step of determining whether the predetermined condition is satisfied comprises:

determining whether the amount of the source frame being buffered is under a minimum level.

9. The method of claim 1, wherein the predetermined condition is an overflow condition or an underflow condition.

10. A method of frame synchronization for converting a source frame to a destination frame, the source frame being received at a first frame rate and the destination frame being outputted at a second frame rate, the destination frame comprising a plurality of horizontal lines, the method comprising the following steps:

buffering at least a part of the source frame;

determining whether a predetermined condition is satisfied; and if the predetermined condition is satisfied, generating a first horizontal line of the horizontal lines corresponding to a first horizontal sync period and generating a second horizontal line of the horizontal lines corresponding to a second horizontal sync period;

wherein the first horizontal sync period is different from the second horizontal sync period;

wherein the first horizontal line comprises a first amount of pixel data comprising a third amount of invisible porch signals, the second horizontal line comprises a second amount of pixel data comprising a fourth amount of invisible porch signals, the first amount is different from the second amount, and the third amount is different from the fourth amount.

11. The method of claim 10, wherein the first frame rate is the same as the second frame rate.

12. The method of claim 10, wherein the predetermined condition is a time interval between a last horizontal sync signal and a vertical sync signal shorter than a time limit.

13. An apparatus for converting a source frame to a destination frame, the source frame being received at a first frame rate and the destination frame being output at a second frame rate, the apparatus comprising:

a buffer for storing at least a part of the source frame; and a converter for converting the source frame to the destination frame with a first amount of pixel data if a predetermined condition is satisfied, and converting the source frame to the destination frame with a second amount of pixel data if the predetermined condition is dissatisfied;

wherein the first amount is different from the second amount;

wherein the first amount of pixel data comprises a third amount of invisible porch signals, the second amount of pixel data comprises a fourth amount of invisible porch signals, and the third amount is different from the fourth amount.

14. The apparatus of claim 13, wherein the converter adjust a time for generating a vertical sync signal if the predetermined condition is satisfied such that the first frame rate is different from the second frame rate, and the converter keeps the time for generating the vertical sync signal unchanged if the predetermined condition is dissatisfied such that the first frame rate is substantially the same as the second frame rate.

15. The apparatus of claim 13, wherein the predetermined condition is a time interval between a last horizontal sync signal and a vertical sync signal shorter than a time limit, and the first amount is more than the second amount if the predetermined condition is satisfied.

16. The apparatus of claim 13, wherein the predetermined condition is a number of pixel data for constructing the destination frame being an odd number, and the first amount is more than the second amount if the predetermined condition is satisfied.

17. The apparatus of claim 13, wherein the predetermined condition is an overflow condition happened to the buffer, and the first amount is fewer than the second amount.

18. The apparatus of claim 17, wherein the converter determines whether the amount of the source frame being buffered is over a maximum level.

19. The apparatus of claim 13, wherein the predetermined condition is an underflow condition happened to the buffer, and the first amount is more than the second amount.

20. The apparatus of claim 19, wherein the converter determines whether the amount of the source frame being buffered is under a maximum level.

21. The apparatus of claim 13, wherein the buffer is a first-in-first-out (FIFO) buffer.

22. The apparatus of claim 13, wherein the predetermined condition is an overflow condition or an underflow condition.

23. An apparatus for converting a source frame to a destination frame, the source frame being received at a first frame rate and the destination frame being output at a second frame rate, the destination frame comprising a plurality of horizontal lines, the apparatus comprising:

a buffer for storing at least a part of the source frame; and a converter coupled to the buffer for determining whether a predetermined condition is satisfied, the converter generating a first horizontal line of the horizontal lines corresponding to a first horizontal sync period and a second horizontal line of the horizontal lines corresponding to a second horizontal sync period if the predetermined condition is satisfied;

wherein the first horizontal sync period is different from the second horizontal sync period;

wherein the first horizontal line comprises a first amount of pixel data comprising a third amount of invisible porch signals, the second horizontal line comprises a second amount of pixel data comprising a fourth amount of invisible porch signals, the first amount is different from the second amount, and the third amount is different from the fourth amount.

24. The apparatus of claim 23, wherein the first frame rate is the same as the second frame rate.

25. The apparatus of claim 23, wherein the predetermined condition is a time interval between a last horizontal sync signal and a vertical sync signal shorter than a time limit.

26. The apparatus of claim 23, wherein the buffer is a first-in-first-out (FIFO) buffer.

* * * * *